US010634359B2

(12) United States Patent
Birnbaum

(10) Patent No.: US 10,634,359 B2
(45) Date of Patent: Apr. 28, 2020

(54) FIREPLACE CAVITY INSERT

(71) Applicant: Howard Birnbaum, Weston, FL (US)

(72) Inventor: Howard Birnbaum, Weston, FL (US)

( * ) Notice: Subject to any disclaimer, the term of this patent is extended or adjusted under 35 U.S.C. 154(b) by 36 days.

(21) Appl. No.: 15/979,377

(22) Filed: May 14, 2018

(65) Prior Publication Data

US 2018/0347818 A1 Dec. 6, 2018

Related U.S. Application Data

(60) Provisional application No. 62/514,408, filed on Jun. 2, 2017.

(51) Int. Cl.
*F24B 1/18* (2006.01)
*F24C 7/00* (2006.01)

(52) U.S. Cl.
CPC ..... *F24B 1/1808* (2013.01); *F24C 7/004* (2013.01)

(58) Field of Classification Search
CPC ..... F24B 1/1808; F24C 7/004; G02B 2027/0114; G02B 27/141; G03B 21/62
See application file for complete search history.

(56) References Cited

U.S. PATENT DOCUMENTS 5,195,820 A * 3/1993 Rehberg ..... F24B 1/1808 126/500
6,393,207 B1 * 5/2002 Martin ..... F24C 7/004 362/806
7,770,312 B2 * 8/2010 Stinson ..... F24C 7/004 40/428
2002/0171940 A1 * 11/2002 He ..... G02B 27/01 359/630
2003/0201957 A1 * 10/2003 Mix ..... F24B 1/1808 345/87
2006/0162198 A1 * 7/2006 Hess ..... F21S 10/04 40/428
2007/0107279 A1 * 5/2007 Wei ..... F24C 7/004 40/428
2008/0216366 A1 * 9/2008 Purton ..... F24C 7/004 40/428
2009/0088263 A1 * 4/2009 O'Neill ..... F24C 7/004 472/65
2009/0241386 A1 * 10/2009 Abileah ..... F24C 7/004 40/428
2011/0030251 A1 * 2/2011 Chen ..... F24C 7/004 40/428
2011/0088297 A1 * 4/2011 Zhu ..... F24C 7/004 40/428
2011/0273364 A1 * 11/2011 Christensen ..... G09F 9/33 345/7
2011/0292657 A1 * 12/2011 Betz ..... F24C 7/004 362/268
2012/0039065 A1 * 2/2012 Sun ..... G02B 27/141 362/84

(Continued)

OTHER PUBLICATIONS

High Performance Thin Film Optical Coatings Technical Reference Document, www.abrisatechnologies.com, 3 pages, 2013. (Year: 2013).*

*Primary Examiner* — David R Dunn
*Assistant Examiner* — Christopher E Veraa
(74) *Attorney, Agent, or Firm* — Neifeld IP Law, PC

(57) ABSTRACT

A fireplace cavity insert provides still and video images appearing to emanate from within the insert.

19 Claims, 2 Drawing Sheets

(56) References Cited

U.S. PATENT DOCUMENTS

| | | | | |
|---|---|---|---|---|
| 2014/0373406 | A1* | 12/2014 | Flynn | F24C 7/004 40/428 |
| 2015/0309264 | A1* | 10/2015 | Abovitz | G02B 6/34 385/33 |
| 2017/0307892 | A1* | 10/2017 | Freeman | G02B 5/0236 |

* cited by examiner

FIREPLACE CAVITY INSERT

CROSS-REFERENCES TO RELATED APPLICATIONS

This application claims benefit of U.S. provisional application 62/514,408 filed Jun. 2, 2017, titled "HoloFlame Insert for a Fireplace," the contents of which are incorporated herein by reference.

BACKGROUND OF THE INVENTION

Indoor fireplaces include a fireplace cavity and a fireplace flue. The fireplace cavity is an open space within a wall of a room in a building delimited by a fireplace aperture in the wall. The fireplace aperture connects the room to the fireplace cavity. The walls and floor defining the fireplace cavity are designed to contain a fire. The fireplace flue is the passage for transporting fumes generated by the fire in the fireplace cavity outside the building. The term fireplace may also refer to portions of the wall and floor in the room that are adjacent the fireplace cavity, such as nonflammable masonry. Both the fireplace cavity and the room extend above and to the sides of the fireplace aperture.

An artificial fireplace is a construct designed to give an impression of a burning fire in a fireplace.

A fireplace cavity insert is anything that can be inserted into a fireplace cavity.

An external wall mantle is a piece of furniture designed to be located in a room and that either defines a fireplace cavity or that includes an artificial fireplace.

Artificial fireplaces do not require a flue because they do not actually burn anything. They require only a structure emulating a fireplace cavity. An external wall mantle that only defines a fireplace cavity defines a cavity suitable for containing a fireplace cavity insert.

U.S. Pat. No. 9,134,032 to Flynn discloses an artificial fireplace for giving an impression of a burning fire in a fireplace, such as for example a fire burning firewood. U.S. Pat. No. 6,393,207 to Martin discloses artificial fireplace including a light randomizer. US patent application publication 2002/0171940 to Zhan discloses an image display system having electrically actuatable image combiner. The contents of U.S. Pat. No. 9,134,032 to Flynn; U.S. Pat. No. 6,393,207 to Martin; and US patent application publication 2002/0171940 to Zhan are incorporated by reference as if fully set forth herein.

SUMMARY OF THE INVENTION

One aspect of the invention is a fireplace cavity insert comprising an enclosure defining an enclosure cavity and an enclosure aperture, and comprising a relatively transparent specular reflector in the enclosure cavity designed to reflect images therefrom through the enclosure aperture from inside the enclosure to outside the enclosure, and an image projector within the enclosure cavity designed to project images generated within the enclosure cavity to the specular reflector.

Relatively transparent specular reflector means a reflector that does not include a metal surface, so that the majority of light which is not reflected by the reflector passes through the reflector. This is in contrast to a metal surface which either reflects or absorbs light impinging the surface. Relatively transparent specular reflectors include dielectric substrates with a partially metallized surface that reflects some light and transmit some light, and include dichroic mirrors which include a dielectric substrate and dielectric coatings.

One aspect of the invention is a method of using a fireplace cavity insert, in which the fireplace cavity insert comprises an enclosure defining an enclosure cavity and an enclosure aperture, and comprising a specular reflector in the enclosure cavity, and comprising an image projector within the enclosure cavity, by projecting images generated within the enclosure cavity by the image projector to the specular reflector and reflecting the images off of the relatively transparent reflector through the enclosure aperture from inside the enclosure to outside the enclosure.

One aspect of the invention is a method of making a fireplace cavity insert comprising fabricating an enclosure defining an enclosure cavity and an enclosure aperture; fixing a relatively transparent specular reflector in the enclosure cavity; fixing an image projector within the enclosure cavity; and positioning and orienting the image projector and the relatively transparent specular reflector so that images projected by the image projector are reflected by the relatively transparent specular reflector through the enclosure aperture from inside the enclosure to outside the enclosure.

The fireplace cavity insert comprises:

(1) an enclosure defining an enclosure cavity having an enclosure aperture;

(2) an image projector such as a monitor, a television, or a projector;

(3) a relatively transparent specular reflector in the enclosure cavity;

(4) wherein the image projector and relatively transparent specular reflector are positioned and oriented such that an image projected by the image projector that impinges the relatively transparent specular reflector is reflected through the enclosure aperture from inside the enclosure to outside the enclosure.

Preferably, the image projector is located within the enclosure cavity.

Preferably, the image projector is located at a position within the enclosure cavity at a location that is not along a line of sight originating outside the enclosure and passing through the enclosure aperture and which line is perpendicular to the plane defined by the enclosure aperture.

Preferably, the image projector is not visible to a person outside the enclosure viewing the interior of the enclosure.

Preferably, the interior surfaces of the enclosure cavity along a line of sight originating outside the enclosure and passing through the enclosure aperture and which line is perpendicular to the plane defined by the enclosure aperture are colored black. However, the rear surface of the enclosure cavity may contain an image of a brick wall or surface, or be formed from imitation brick or actual brick.

Preferably, the interior surfaces of the enclosure cavity that are visible to a person outside the enclosure cavity are colored black, so as to minimize their reflectivity in the visible spectrum.

Preferably, the relatively transparent specular reflector is a dichroic mirror.

Preferably, fireplace cavity insert is designed to fit within a fireplace cavity and have the enclosure aperture open into a room containing the fireplace cavity.

The term image projector herein covers any device that can produce images, including computer monitors, computer screens, televisions, and conventional projectors.

The image projector is positioned within the enclosure cavity so that it is generally hidden from the view of an observer outside the enclosure cavity. The specular reflector is positioned within the enclosure cavity so that it is along a line of site perpendicular to a plane defined by the enclosure aperture, that is a plane defined by the edges of the enclosure that delimit the enclosure aperture.

Preferably, the enclosure is formed from plural pieces of sheet metal bent to shape and connected mechanically together by screw, rivets, brazing, or welding. A specular reflector fixture for the specular reflector is secured to the interior of the enclosure preferably by welding, soldering, bolting, or screwing. The specular reflector fixture is designed so that the reflector when secured to the fixture and the fireplace cavity insert is installed in a fireplace cavity, the reflector is canted relative to the horizontal.

An image projector fixture for fixing the image projector is formed in or secured to the enclosure preferably by welding, soldering, bolting, or screwing. The image projector fixture is designed so that it can fix an image projector at a location that faces the specular reflector so that light emanating from the image projector can reflect off the specular reflector and exit the enclosure aperture. Preferably, the specular reflector fixture is designed to be able to adjust cant of the specular reflector between 20 and 70 degrees relative to the horizontal. Preferably, the specular reflector fixture is set to provide a cant of 45 degrees to the specular reflector.

The optically dark or black surface may be formed on sheet metal by coating typically applied electrostatically which is then cured under heat to allow it to flow and form a "skin." The powder in this coating may be a thermoplastic or a thermoset polymer. This process creates a hard finish that is tougher than conventional paint. Alternatively, a metal surface can be blackened by brush or roll or spray on painting of an optically dark or black paint.

Preferably, the relatively transparent specular reflector is nominally flat so that it project images without magnification. However, the specular reflector define a curved reflective surface so that an image projected by the monitor, television, or projector are magnified.

The term dichroic mirror as used herein refers to a structure comprising a transparent substrate such as glass or quartz with dielectric coatings thereon to provide a relatively constant and high reflection coefficient across the visible spectrum. Suitable dichroic mirrors are commercially available from Abrisa Technologies. Dichroic mirrors of this invention are also referred to as beam splitters.

Preferably, the dichroic mirrors comprise dielectric coatings that provide reflection of at least 30, more preferably at least 40, more preferably at least 50, and most preferably at least 70 percent of light (reflectance), for light incident at 45 degrees, from 400 to 700 nanometers (nm), that is across the visible spectrum. Preferably, the variation of reflectance from 400 to 700 nm at an incident angle of 45 degrees onto the dichroic mirror is less than 15 percent of total incident light. These dichroic mirrors result in reflections in which colors are not muted and reflected images are sharp and clear.

The dichroic mirror may be canted at 45 degrees relative to a normal to the plane defined by the enclosure aperture. However, the angle need not be 45 degrees. Lower and higher angles relative to this normal are contemplated. For example, angles greater than or less than 45 degrees may be beneficial when the enclosure is raised above or lowered below the level of the floor of the adjoining room. Accordingly, the cant relative to the normal to the plane defined by the enclosure aperture may range from 20 to 70 degrees, and more preferable from 30 to 60 degrees.

Consequently a viewer looking through the enclosure aperture into the enclosure cavity perceives an image based upon the light reflected by the dichroic mirror and does not perceive a dichroic mirror surface; does not see the monitor, television, or projector because that structure is not along a line of site; and does not perceive reflections from the black surface behind the dichroic mirror because that surface reflects minimal light. The net result of these effects is that a viewer perceives an image to be along a line of sight to the back of the cavity and within the enclosure cavity, when that image is displayed or projected from the monitor, television, or projector to the dichroic mirror.

Preferably, the fireplace cavity insert includes an observable physical structure within the enclosure cavity that appears to overlap with the virtual image. For example, the observable physical structure may be simulated firewood, simulated hot coals, or simulated hot volcanic stones, and the virtual image may be flames.

Preferably, the location of the monitor, the location and tile of the dichroic mirror, and the location of the observable physical structure are configured to display to the observer the flames emanating from the simulated firewood, simulated hot coals, or simulated hot volcanic stones.

The fireplace cavity insert may also include a surface input touchscreen pad for controlling one or more microcontrollers controlling the monitor, television, or projector. The touchscreen allows a user to select which of plural visual effects to have displayed on the monitor, television, or projector. for example, a video image of a movie, a video image of flames. The touchscreen may also allow a user to control the background light effect, such as type of orange glow correlated to image effect.

The fireplace cavity insert may also include speakers within or near the enclosure, such as adjacent or in imitation logs in the enclosure, and the touchscreen may also allow the user to control audio effects and to have the speaker play sound associated with the video or still images projected by the image projector.

The device may also include wireless transmission capability such as Blue Tooth for wireless control and infrared reception capability to allow for infra red wireless control.

The fireplace cavity insert is designed to fit into a preexisting cavity, container, or fireplace, as an insert.

Alternatively, the fireplace cavity insert may be part of a structure, such as a mantle, forming portions of the wall of a room.

The device may include additional features. On addition feature is lighting. For example the device may include lights within the enclosure cavity that provide a lighting effect, such as an orange glow to either or both of the enclosure cavity and a room outside the enclosure.

The fireplace cavity insert may include either speakers or an audio interface to transmit audio commands to speakers.

The fireplace cavity insert may include an input device for inputting commands to the device to provide various effects, such as different images and different sounds. The input device may be a touchscreen or a remote controller and wireless receiver. The remote controller may be a dedicated remote controller, such as an infrared or wireless device controller hardwired to provide the commands controlling the device. The remote controller may be generic computer device with wireless transmission capabilities and software designed to generate and transmit the commands designed to control the device.

The controller is designed to control what is displayed on the monitor, television, or projector. The controller may be designed to control sounds associated with what is displayed or provide other sounds. The controller may be designed to control the optional lighting.

The fireplace cavity insert preferably has (stores in some form of memory) plural different flames videos and a corresponding sound stream associated with each such video.

The fireplace cavity insert may be designed to fit into a pre-existing container, or existing fireplace, as an insert. Alternatively, the enclosure of the device may have finished exterior walls designed to be free standing in a room.

The fireplace cavity insert may also include a heater for heating air, within the enclosure cavity.

For emulating a fireplace, light effects may include one or both of LED fire effects simulation lights and a flicker effects controller for flickering the LED lights. The LED fire effects simulation lights may be polychromatic LED light sources that provide an ember orange glowing fire appearance. The device may include filters for filtering the color provided by the LED light sources, such standard theatrical filter gels to shift the color either to the yellow side or red side of the spectrum for the desired effect needed for a lighting project. The device may also include white diffuse reflectors for adding color mixing, and in conjunction with a white reflector for faux fire simulation. The device may also include a light spreading medium, such as a rubber glass. Rubber glass is a special effects, clear, silicone material for props that in small pieces readily spreads and diffuses the light for a glowing appearance. The device may include multiple flicker controls and ember orange LED bulbs. The FEC1 Flicker Effects Control is a controller for LED flame flicker simulation and for glowing goal and ember effects that can provide 6 different flicker modes and 10 flicker speeds (how fast a flicker step changes); this provides up to 60 different effects settings. Each of the 6 modes or flicker patterns is characterized by the flicker depth (how low a flicker step dims) and the overall nominal light output percentage.

DETAILED DESCRIPTION OF THE EMBODIMENT

Figure 1:
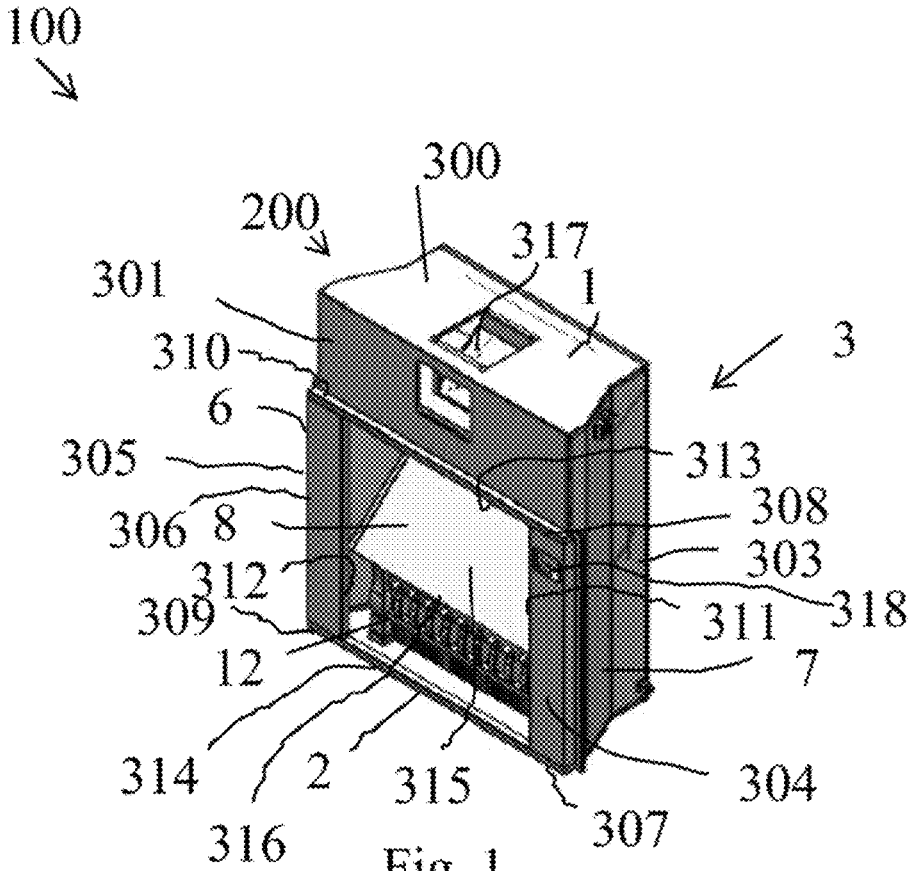
FIG. 1 is a perspective view of an embodiment of the invention.

FIG. 1 shows fireplace cavity insert 100 including an enclosure 200, dichroic mirror 8, simulated firewood 12.

Enclosure 200 comprises enclosure top panel 1; enclosure bottom panel 2; enclosure right panel 6; enclosure left panel 7; and enclosure back panel 3. Enclosure back panel 3 is indicated by an arrow because it is not visible in FIG. 1.

Enclosure back panel 3 extends between the rear sides of enclosure top panel 1; enclosure bottom panel 2; enclosure right panel 6; and enclosure left panel 7.

Enclosure top panel 1 forms a ninety degree bend so that enclosure top panel comprises one relatively flat top region 300 and one relatively flat top panel front facing region 301.

Enclosure right side panel 7 has a bend so that enclosure right side panel 7 has one relatively flat enclosure right side panel right facing region 303 and one relatively flat enclosure right side panel front facing region 304.

Enclosure left side panel 6 similarly has a bend so that enclosure left side panel 6 has one relatively flat left side panel left side region 305 that is hidden from view and one relatively flat enclosure left side panel front region facing 306.

Enclosure bottom panel 2 extends between a lower edges of enclosure right panel 6; enclosure left panel 7; and enclosure back panel 3.

Top panel relatively flat front facing region 301 has a lower edge that extends from enclosure right side panel side facing region 303 to enclosure left side panel front facing region 306.

Enclosure right side panel front facing region 304 extends from a right side portion 307 of a front edge of enclosure bottom panel 2 to a right side portion 308 of a lower edge of top panel front facing region 301.

Enclosure left side panel front facing region 306 extends from a left side portion 309 of a front edge of enclosure bottom panel 2 to a left side portion 310 of a lower edge of top panel front facing region 301.

Inner edge 311 of enclosure right side panel front facing region 304; inner edge 312 of enclosure left side panel front facing region 306; lower edge 313 of enclosure top panel front facing region 301; and front edge 314 of enclosure bottom panel 2 connect to define a perimeter of enclosure aperture 315. Enclosure aperture 315 is an aperture into enclosure 2.

The front surfaces of: enclosure right side panel front facing region 304; enclosure left side panel front facing region 306; and enclosure top panel front facing region 301 are generally planar, defining a plane extending perpendicular to the major surfaces of enclosure bottom panel 2.

Dichroic mirror 8 defines a front surface whose lower edge 316 is approximately parallel to the front edge 314 of the enclosure bottom panel 2. Dichroic mirror 8 is canted so that its upper edge is further away from the front than lower edge 316. Dichroic mirror 8 is canted preferably at about 45 degrees relative to the plane extending perpendicular to the major surfaces of enclosure bottom panel 2.

Figure 2:
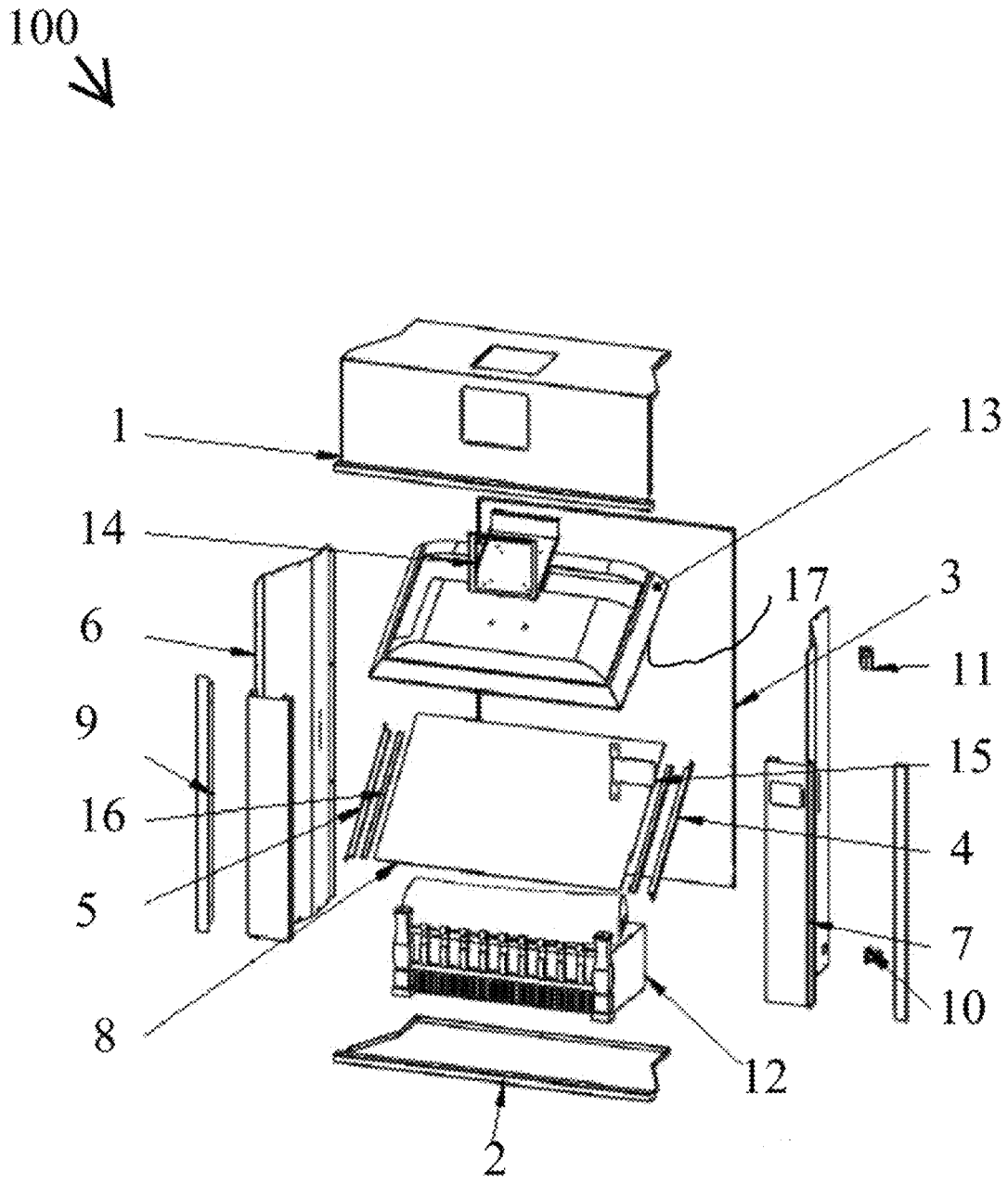
FIG. 2 is an exploded perspective view of components of the first embodiment.

Enclosure top panel 1 defines mounting apertures 317 for mounting image projector (monitor, television, or projector) 13 with mounting bracket 14 (see FIG. 2).

Enclosure right side panel front facing region 304 retains touch sensitive controller 318.

FIG. 2 is an exploded perspective view of fireplace cavity insert 100 of FIG. 1. FIG. 2 shows top panel 1; bottom panel 2; back panel 3; right dichroic mirror mount channel 4; left dichroic mirror mount channel 6; enclosure left panel 7; dichroic mirror 8; locking bracket 9; electrical connector 10; electrical connector 11; hot air heater 12; image projector (monitor, television, or projector) 13; image projector mounting bracket 14; bracket 15; and rubber edge trim 16. The dichroic mirror mount channels are fixed in place to the enclosure's side panels by fixtures (not shown).

FIG. 2 shows that monitor, television, or projector 13 is in the preferred embodiment a TV or monitor having a display surface 17 (hidden from view) that faces the canted surface of the dichroic mirror. Display surface 17 may be parallel to the surface of dichroic mirror 8.

TV or monitor 17 is secured by bracket 14 to enclosure upper panel 1. TV or monitor 17 has a lower surface that is above the lower edge 313 of enclosure top panel front facing region 301 and therefore is generally hidden from view to anyone outside of enclosure 200. Bracket 15 is designed to hold a single board computer, which includes control circuitry for the device.

In the preferred embodiment, the fireplace cavity insert includes memory storing video image data, such as images of fires in fireplaces, and suitable user interface for allowing a person to control via the single board computer which still or video image to have the image projector project.

In the preferred embodiment, lower edge 316 of dichroic mirror 8 is proximate aperture 315. Alternative preferred embodiments have lower edge 316 displaced further into enclosure 200 to limit azimuthal angles at which a viewer has line of sight to dichroic mirror 8.

While the preferred embodiment has been described with reference to FIGS. 1 and 2, variations that do not depart from the novel concepts of the invention are contemplated. The size and shape of the enclosure are not essential. However, a size large enough to simulate the area of a conventional fireplace is desirable. So the preferably, the enclosure aperture is not smaller than one foot in any direction. The displacement of the dichroic mirror further into the cavity is not essential. The preferred angle of the relatively transparent specular reflector (such as a dichroic mirror) for the preferred embodiment is 45 degrees. However, relatively transparent specular reflectors can be designed to have high reflectivity that is relatively wavelength independent across the visible spectrum for angles other than 45 degrees, and therefore canting the dichroic reflector at 45 degrees is not essential. Further the image generated by the TV, monitor, or projector, may project to the dichroic reflector at various angles and still be reflected out of the enclosure aperture to viewers.

The orientations and cants of the relatively transparent specular reflector (such as a dichroic reflector) and TV, monitor, or projector, could be inverted. The TV, monitor, or projector, may reside in a recess in the bottom of the enclosure and project an image upwards, and the relatively transparent specular reflector could be canted so that its bottom edge was closer to the back of the enclosure than to the enclosure aperture, so that the relatively transparent specular reflector would reflect light emanating from the TV, monitor, or projector out of the enclosure aperture.

The novel fireplace cavity insert may be made by assembling components into an enclosure, by assembling the TV, monitor, or projector into a space within the enclosure that is generally not visible from outside the enclosure, such as specifically within the enclosure and proximate the inner surface of the top panel front facing region 301 and above the lower lip 313 of the top panel front facing region 301. And placing relatively transparent specular reflector having a high reflectance that is relatively constant across the visible spectrum in the enclosure positioned to reflect light out of the enclosure aperture. And blackening the inner surface of at least the portion of the cavity defined by the enclosure along a line of site passing through the relatively transparent specular reflector.

Preferably, the interior surfaces of back panel 3; top panel 1; bottom panel 2; right panel 6; left panel 7; are blackened.

The invention also includes the method of using the device, by providing electrical power to the device to power the image projector, ancillary lighting, and sound, and by controlling the device by selecting a still or video image from a library of visual images stored in a memory device for projecting from the image projector, and by controlling the fireplace cavity insert to generate hot air, and turn on and off, on command, at predetermined specified times.

The invention claimed is:

1. A system comprising:

monitor or television or projector, dichroic reflector, and a black back surface within the enclosure;

the monitor is located toward the top of the enclosure;

the dichroic reflector is located so that part of the dichroic reflector it is within the line of site of a viewer outside the enclosure looking towards a viewer opening located in a front side of the enclosure;

wherein the black back surface is located within the enclosure on the opposite side of the dichroic reflector from the viewer opening;

wherein the monitor, dichroic reflector, and black surface are arranged relative to one another so that an image displayed on the monitor is reflected by dichroic mirror generally towards the viewer opening;

wherein the black back surface prevents or inhibits light from behind the dichroic mirror from reflecting towards the dichroic mirror.

2. The system of claim 1 where the net result of these effects is that an image displayed upon the monitor appears to exist within the enclosure and the visibility of the dichroic mirror is minimized.

3. The system of claim 1 further comprising diode lights within the enclosure that provide a lighting effect to the visible interior surface of the fireplace enclosure.

4. The system of claim 3 wherein the diode lights comprise:

(1) LED fire effects simulation light; and (2) EC1 Flicker Effects Control for LED lighting for flame simulation.

5. The system of claim 1 in which the monitor's surface providing an image is canted relative to the horizontal so that the monitor projects an image down and towards the back of the enclosure and the dichroic mirror is canted up and toward so that it projects the image impinging its surface generally out of the viewer opening.

6. The system of claim 1 in which the dichroic mirror provides a substantially uniform reflection coefficient at 45 degree angle of incidence from 450 nanometers to 650 nanometers.

7. A fireplace cavity insert, comprising:

(1) an enclosure defining an enclosure cavity having an enclosure aperture;

(2) an image projector such as a monitor, a television, or a projector;

(3) a relatively transparent specular reflector comprising a dichroic mirror in the enclosure cavity;

(4) wherein the image projector and relatively transparent specular reflector are positioned and oriented such that an image projected by the image projector that impinges the relatively transparent specular reflector is reflected through the enclosure aperture from inside the enclosure to outside the enclosure; and a black back surface within the enclosure that is positioned to prevent or inhibits light from behind the dichroic mirror from reflecting towards the dichroic mirror.

8. The fireplace cavity insert of claim 7, wherein the image projector is located within the enclosure cavity.

9. The fireplace cavity insert of claim 7, wherein the image projector is located at a position within the enclosure cavity at a location that is not along a line of sight originating outside the enclosure and passing through the enclosure aperture and which line is perpendicular to the plane defined by the enclosure aperture.

10. The fireplace cavity insert of claim 7, the image projector is not visible to a person outside the enclosure viewing the interior of the enclosure.

11. The fireplace cavity insert of claim 7, wherein the interior surfaces of the enclosure cavity along a line of sight originating outside the enclosure and passing through the enclosure aperture and which line is perpendicular to the plane defined by the enclosure aperture are colored black.

12. The fireplace cavity insert of claim 7, wherein the interior surfaces of the enclosure cavity that are visible to a person outside the enclosure cavity are colored black, so as to minimize their reflectivity in the visible spectrum.

13. The fireplace cavity insert of claim 7, wherein the dichroic mirror reflects at least 30 percent of visible light for light incident at 45 degrees.

14. The fireplace cavity insert of claim 7, wherein the dichroic mirror reflects at least 40 percent of visible light for light incident at 45 degrees.

15. The fireplace cavity insert of claim 7, wherein the dichroic mirror reflects at least 50 percent of visible light for light incident at 45 degrees.

16. The fireplace cavity insert of claim 7, further comprising a memory device storing video image of a flame, and wherein the fireplace cavity insert is configured to have the image projector display the video image of the flame, so that the image of the flame appears to emanate from within the fireplace cavity insert.

17. A method of using a fireplace cavity insert, comprising: (1) an enclosure defining an enclosure cavity having an enclosure aperture; (2) an image projector such as a monitor, a television, or a projector; (3) a relatively transparent specular reflector comprising a dichroic mirror in the enclosure cavity; (4) wherein the image projector and relatively transparent specular reflector are positioned and oriented such that an image projected by the image projector that impinges the relatively transparent specular reflector is reflected through the enclosure aperture from inside the enclosure to outside the enclosure, and wherein a black back surface within the enclosure that is positioned to prevent or inhibits light from behind the dichroic mirror from reflecting towards the dichroic mirror, the method comprising:

(1) connecting the fireplace cavity insert to a source of electrical power; and (2) controlling the image projector to display the video image of a flame, so that the image of the flame appears to emanate from within the fireplace cavity insert.

18. The method of claim 17 wherein the dichroic mirror reflects at least 30 percent of visible light for light incident at 45 degrees.

19. The method of claim 17 further comprising controlling the image projector to display a different video image than the video image of said flame.

* * * * *